United States Patent [19]

Atkinson

[11] 4,182,470

[45] Jan. 8, 1980

[54] CARRYING DEVICE

[76] Inventor: Kenneth R. Atkinson, Wisteria Cottage, 288 Leigham Court Rd., Streatham, London, England

[21] Appl. No.: 867,885

[22] Filed: Jan. 9, 1978

[30] Foreign Application Priority Data

Feb. 9, 1977 [GB] United Kingdom ..... 5315/77

[51] Int. Cl.[2] ..... A45F 5/00

[52] U.S. Cl. ..... 224/183; 24/201 B; 150/1.5 B; 248/206 A

[58] Field of Search ..... 224/3, 5 R, 5 A, 5 B, 224/26 R, 26 B, 28 R, 25 R, 2 C, 5 H, 5 Y, 5 M, 5 N, 13, 14, 21, 22, 5 Z, 5 V; 2/DIG. 6, 311, 312, 314, 315, 338; 24/3 R, 201 B, 73 MS; 150/1.5 R, 1.5 B; 248/206 A

[56] References Cited

U.S. PATENT DOCUMENTS

| | | | |
|---|---|---|---|
| 1,639,383 | 8/1927 | Moretti et al. | 224/5 N UX |
| 2,372,685 | 4/1945 | Schaich | 24/201 B UX |
| 2,597,601 | 5/1952 | Sherman | 224/5 R X |
| 2,910,804 | 11/1959 | White | 224/2 C X |
| 3,136,547 | 6/1964 | Shaper | 224/5 R UX |
| 3,220,018 | 11/1965 | Johnson | 24/201 B X |
| 3,305,148 | 2/1967 | Zimmerman | 224/5 V |
| 3,743,147 | 7/1973 | Wilczynski | 224/26 R |

*Primary Examiner*—Jerold M. Forsberg
*Attorney, Agent, or Firm*—Fleit & Jacobson

[57] ABSTRACT

A carrying device which comprises a belt which is adapted to be worn around a person's waist and which has attached thereto at least one magnetic member, the said metallic member being able to hold metallic objects by magnetism.

4 Claims, 5 Drawing Figures

CARRYING DEVICE

This invention relates to a carryiing device. More specifically, this invention relates to a carrying device that is adpated to be worn by a person carrying one or more objects.

Persons such for example, as mechanics, carpenters, do-it-yourself enthusiasts and tailors frequently need to have metallic objects nearby and ready for immediate use. For example, if a person is screwing two parts together, he will first align the parts and then he will need a screw and a screwdriver nearby so that he can pick them up without moving the alignment of the parts. Hammers, pincers, nails, pins and nuts and bolts are a few examples of other objects that are frequently required to be immediately on hand by a person doing a job of work.

It is an aim of the present invention to provide a carrying device which can be worn by a person such that the person can carry one or more objects in an easy and convenient manner.

Accordingly, this invention provides a carrying device comprising an elongate member which is adapted to be worn and at least one magnetic member which is attached to the elongate member and which is adapted to hold metallic objects by magnetism.

The elongate member may be a belt or a shoulder strap and the or each magnetic member may be stuck or otherwise secured to the elongate member. If non-metallic objects are to be carried, a container can be attached to the or each magnetic member for receiving the non-metallic objects. Preferably, the container will itself be metallic so that it can be held by magnetism to its magnetic member. However if desired, the container could be stuck, rivetted or otherwise secured to its magnetic member.

In one embodiment of the invention, the carrying device is of assistance to persons carrying relatively heavy objects. For example, a workman carrying a ladder or a scaffolding pole may carry it on one shoulder whilst a woman carrying a shopping bag may carry it in one hand. The person carrying the object tends to lean away from the object to counteract the weight of the object. The person's spine is thus moved off the vertical position and strain is placed on various muscles, especially in the back. In many instances, back pain results.

The present invention helps to alleviate this problem by providing a carrying device comprising a shoulder strap, a first magnetic member which is adapted to have attached thereto an object to be carried or means for supporting the object to be carried, and a second magnetic member which is adapted to be attached to a person who is to carry the object, the carrying device being such that in use it is worn by the person with the first and second magnetic members attached together, the device then distributing the weight of the object thereon towards the first and second magnetic members which are so positioned with respect to the person's body as to reduce the need for the person to lean off the vertical position to counteract the weight of the object being carried.

Usually, the first and second magnetic members will be discs since discs give a relatively large surface contact area for magnetisation purposes, whilst at the same time being easy to slide apart so that the object being carried can easily be separated from the person carrying it.

The first magnetic member may be attached to a strap, the strap being adapted to be secured to the object to be carried, or to a container for the object or objects to be carried. The strap can be releasably or permanently fixed to the container. If desired, the first magnetic member can be permanently fixed directly to the container, for example by rivets, so that then a fixing strap is not needed.

The container may be a golf bag, a shopping bag or a tool box. Obviously, any type of object can be deposited in the container, for example golf clubs in the case of a golf bag, shopping in the case of a shopping bag and tools or household repair devices in the case of a tool box. In the case of objects such as ladders and scaffolding poles, the objects can be secured to the first magnetic member by the aforementioned strap or they could be hooked over hooks or the like. Generally, any non-ferrous carrying tools or metal objects can be carried, whether for use in industry or in the house.

In one embodiment of the invention, the first magnetic member is attached to a weight re-distributing bar, the bar being adapted to receive the object or objects to be carried. The bar can thus slip through the handle of a shopping bag or it can be provided with hooks or the like for receiving, for example, the shopping bag handle or a ladder.

The second magnetic member is preferably attached to a belt which forms part of the carrying device of the invention and which is for fixing around the person's waist. However, if desired, the second magnetic member could be secured in position by other means such for example as securing it to an article of clothing, for example to the back of a jacket.

The device of the invention may be made of various materials. The elongate member or the shoulder strap are preferably made of leather although plastics materials may also be used. The first and second magnetic members must obviously be made of a magnetic material but various types of magnetic materials may be employed giving stronger or weaker magnetism as desired. The size of the first and second magnetic members may also be varied to suit requirements. Thus for example, 2½ or 3 inch diameter discs may be employed.- Magnetic poliymer materials give good magnetism and they are lighter than many conventional magnetic metals.

Embodiments of the invention will now be described solely by way of example and with reference to the accompanying drawings in which.

Figure 1:
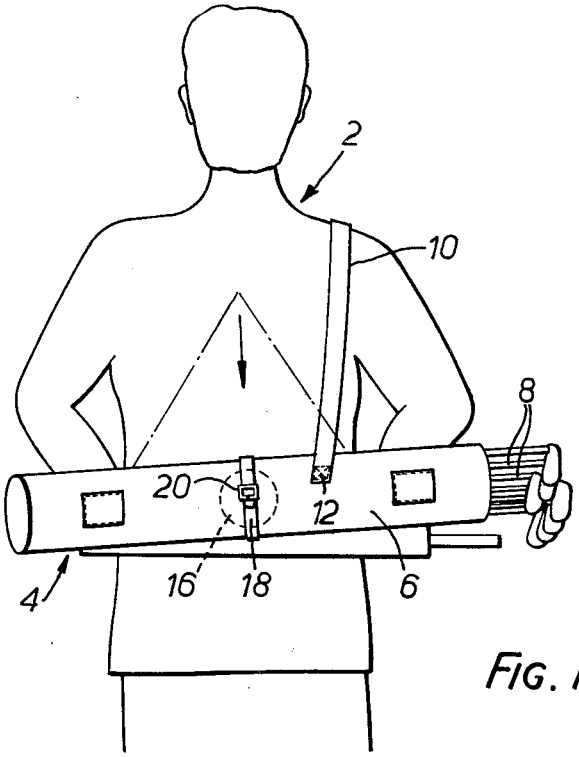
FIG. 1 is a rear view of part of a male golfer wearing a first carrying device of the invention.
Figure 2:
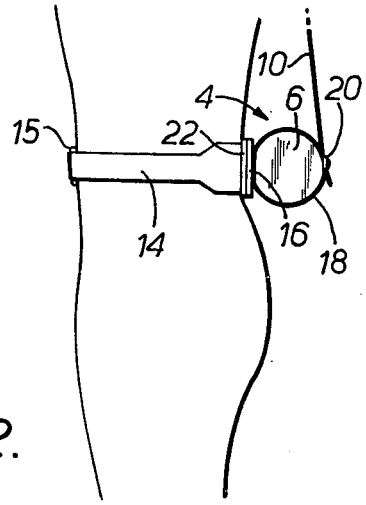
FIG. 2 is a side view of the carrying device shown in FIG. 1, the part of the golfer shown being in outline only for simplifying the illustration.

Referring to FIGS. 1 and 2, there is shown a golfer 2 wearing a carrying device 4 of the invention, the device 4 supporting a golf bag 6 having golf clubs 8 in it.

The device 4 comprises a shoulder strap 10 which is worn as shown. One end of the strap 10 is attached to the bag 6 at 12. The other end of the strap 10 can be attached to the golf bag, as in the usual golf bag construction, or it can be attached to the front part of a belt 14 forming part of the device 4. The belt 14 can be secured about the waist of the golfer 2 by means of a buckle or other fastening device 15.

The bag 6 has a first magnetic disc 16 attached to it by means of a strap 18 having a buckle or other fastening device 20. In an alternative construction, the disc 16 can be secured directly, for example by rivets, to the bag 6. The belt 14 has a second magnetic disc 22 attached to it, for example by means of rivets.

When the device 4 is worn as shown, the weight of the bag 6 and the clubs 8 is supported on the person's right shoulder by means of the shoulder strap 10. However, by virtue of the fact that the discs 16 and 22 are stuck together, the centre of gravity of the bag 6 and the clubs 8 is transferred from the right side of the golfer 2 towards the centre and base of his back where considerable weight can be supported without substantial spinal distortion. When playing golf, the golfer 2 will often desire quickly to put the bag 6 down. This can easily be effected by slipping the shoulder strap 10 off the shoulder when the extra sudden weight will cause the discs 16, 22 to slide apart and the bag 6 can then slide to the ground.

Figure 3:
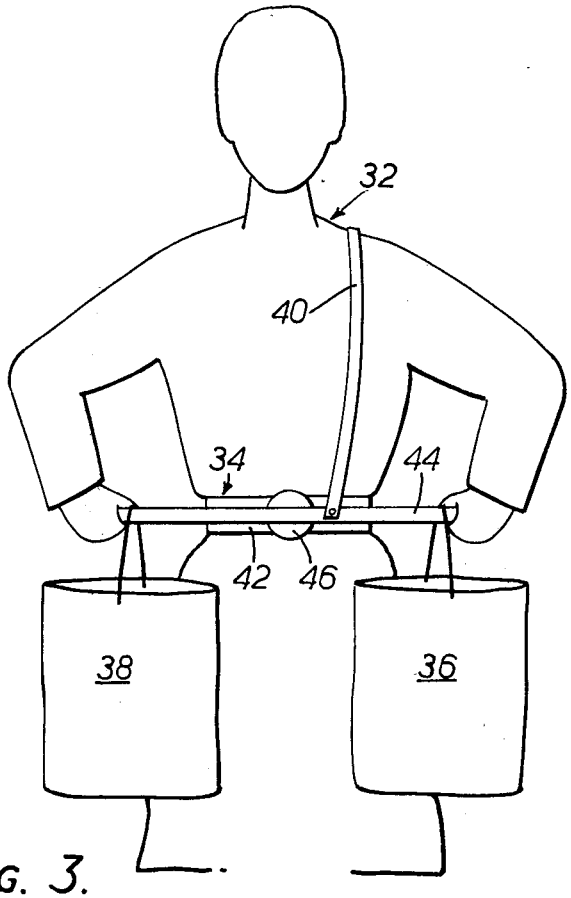
FIG. 3 is a front view of a part of a woman shopper wearing a second carrying device of the invention.
Figure 4:
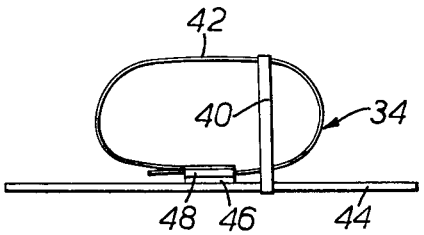
FIG. 4 is a plan view of the carrying device shown in FIG. 3.

Referring now to FIGS. 3 and 4, there is shown a shopper 32 wearing a carrying device 34 of the invention, the device 34 supporting a pair of shopping bags 36, 38.

The device 34 comprises a shoulder strap 40 which is worn as shown. One end of the strap 40 is attached to a waist belt 42 and the other end of the strap 40 is attached to a weight re-distributing bar 44. The waist belt 42 can fasten about the point 46 by means of a buckle or other fastener. As shown, the bar 44 is supporting the shopping bags 36, 38.

A first magnetised disc 46 is attached to the bar 44 and a second magnetised disc 48 is attached to the belt 42. The disc 48 can conveniently hide the buckle for the belt 42 or, alternatively, the disc 48 could be formed with an integral buckle.

As will be seen from FIG. 3, the weight of the shopping bags 36, 38 tend to balance each other out. Also, the weight is transmitted to a large extent to the discs 46, 48 which are centrally disposed on the shopper 32 where a substantial weight can be supported without undue spinal distortion.

Figure 5:
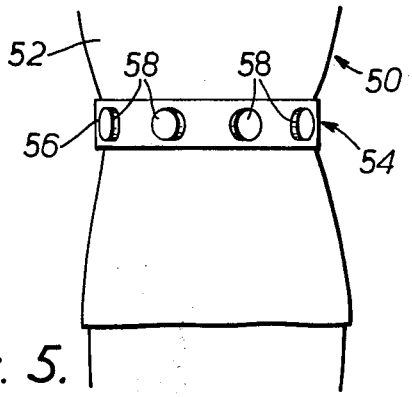
FIG. 5 is a rear view of part of a man wearing a third carrying device of the invention.

Referring now to FIG. 5, there is shown part of a man 50 wearing a jacket 52 and a carrying device 54 around his waist. The carrying device 54 is in the form of a belt 56 having four magnetic discs 58 stuck to it by an adhesive. The discs 58 can have screws, nails, pins, scissors, carpenter's tools, mechanic's tools and various other objects stuck to them by magnetism. The discs 58 can be arranged at the front or the back of the man 50 or, if desired, the discs 58 can extend entirely around the belt 56. The use of the device 54 will help workmen to avoid dropping and/or misplacing tools and other objects and this will facilitate the speedier completion of the job being undertaken.

It is to be appreciated that the embodiments of the invention described above have been given by way of example only and that modifications may be effected. Thus, for example, the golf bag 6 could be a tool or house-hold repair box carrying tools, paint-brushes and the like. Similarly, the bags 36, 38 could carry the tools, paint-brushes and the like, or ladders could be hooked over the ends of the bar 44. Also, the bar 44 could be provided with hooks for receiving the handles of the bags 36, 38. Further, the discs 58 could be ring-shaped and they could be held to the belt 56 by rivets or other fastening means.

I claim:

1. A carrying device comprising an elongate member which is adapted to be worn, a first magnetic disc which is directly adhered to the elongate member, a second magnetic disc which is releasably secured to the first magnetic disc by magnetism, and a fixing strap which passes around a golf bag to secure the golf bag to the fixing strap, the second magnetic disc being directly adhered to the fixing strap, and the carrying device being such that the first and second magnetic discs can be separated from each other by a sliding action to enable the golf bag to be removed from the elongate member so that it can be filled and emptied.

2. A carrying device according to claim 1 in which the elongate member has a first portion for fixing around a person's waist and a second portion for fixing over a person's shoulder.

3. A carrying device comprising an elongate member which is adapted to be worn, a first magnetic disc which is directly adhered to the elongate member, a second magnetic disc which is releasably secured to the first magnetic disc by magnetism, a weight re-distributing bar, and a bag, the second magnetic disc being directly adhered to the weight re-distributing bar, the bag being secured to the weight re-distributing bar, and the carrying device being such that the first and second magnetic discs can be separated from each other by a sliding action to enable the bag to be removed from the elongate member so that it can be filled and emptied.

4. A carrying device according to claim 3 in which the elongate member has a first portion for fixing around a person's waist and a second portion for fixing over a person's shoulder.

* * * * *